US010446306B2

(12) United States Patent
Satoh et al.

(10) Patent No.: US 10,446,306 B2
(45) Date of Patent: Oct. 15, 2019

(54) METHOD FOR MANUFACTURING R-T-B BASED SINTERED MAGNET

(71) Applicant: HITACHI METALS, LTD., Tokyo (JP)

(72) Inventors: Teppei Satoh, Mishima-gun (JP); Futoshi Kuniyoshi, Mishima-gun (JP); Rintaro Ishii, Mishima-gun (JP); Ryouichi Yamagata, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 335 days.

(21) Appl. No.: 15/511,299

(22) PCT Filed: Aug. 31, 2015

(86) PCT No.: PCT/JP2015/074777
§ 371 (c)(1),
(2) Date: Mar. 15, 2017

(87) PCT Pub. No.: WO2016/043039
PCT Pub. Date: Mar. 24, 2016

(65) Prior Publication Data

US 2017/0256344 A1 Sep. 7, 2017

(30) Foreign Application Priority Data

Sep. 17, 2014 (JP) ..... 2014-188836

(51) Int. Cl.
*B22F 3/10* (2006.01)
*H01F 7/02* (2006.01)
(Continued)

(52) U.S. Cl.
CPC ..... *H01F 1/08* (2013.01); *B22F 3/24* (2013.01); *C21D 6/00* (2013.01); *C22C 33/02* (2013.01);
(Continued)

(58) Field of Classification Search
None
See application file for complete search history.

(56) References Cited

U.S. PATENT DOCUMENTS 5,472,525 A * 12/1995 Tokunaga ..... H01F 1/057 148/302
5,595,608 A * 1/1997 Takebuchi ..... H01F 1/0577 148/103
(Continued)

FOREIGN PATENT DOCUMENTS

CN 103620707 A 3/2014
CN 105474337 A 4/2016
(Continued)

OTHER PUBLICATIONS

International Preliminary Report on Patentability dated Mar. 30, 2017 issued by the International Bureau in International Application No. PCT/JP2015/074777 with translation of Written Opinion.
(Continued)

*Primary Examiner* — Xiaowei Su
(74) *Attorney, Agent, or Firm* — Sughrue Mion, PLLC

(57) ABSTRACT

A method for manufacturing an R-T-B based sintered magnet includes: 1) a step of preparing an R-T-B based sintered magnet material by sintering a molded body, the sintered magnet material having a particular composition and satisfying inequality expressions (1) and (2); 2) a high-temperature heat treatment step of heating the sintered magnet material to a heating temperature of 730° C. to 1,020° C. and then cooling the sintered magnet material to 300° C. at a cooling rate of 5° C./min or more; and 3) a low-temperature heat treatment step of heating the sintered magnet material after the high-temperature heat treatment step to 440° C. to 550° C.:

$$[T]-72.3[B]>0 \quad (1)$$

$$([T]-72.3[B])/55.85<13[Ga]/69.72 \quad (2)$$

(Continued)

where [T] is a T content in percent by mass, [B] is a B content in percent by mass, and [Ga] is a Ga content in percent by mass.

2 Claims, 1 Drawing Sheet

(51) Int. Cl.

| | |
|---|---|
| ***H01F 1/057*** | (2006.01) |
| ***H01F 1/08*** | (2006.01) |
| ***B22F 3/24*** | (2006.01) |
| ***C21D 6/00*** | (2006.01) |
| ***C22C 33/02*** | (2006.01) |
| ***C22C 38/00*** | (2006.01) |
| ***H01F 41/02*** | (2006.01) |
| *C22C 38/06* | (2006.01) |
| *C22C 38/16* | (2006.01) |

(52) U.S. Cl.
CPC ..... *C22C 38/00* (2013.01); *H01F 1/0577* (2013.01); *H01F 41/02* (2013.01); *B22F 2999/00* (2013.01); *C22C 38/06* (2013.01); *C22C 38/16* (2013.01)

(56) References Cited

U.S. PATENT DOCUMENTS

| | | | | |
|---|---|---|---|---|
| 2004/0094237 | A1* | 5/2004 | Nomura | H01F 1/0577 148/302 |
| 2014/0132377 | A1 | 5/2014 | Nakajima et al. | |
| 2014/0184370 | A1 | 7/2014 | Hidaka et al. | |
| 2015/0170810 | A1* | 6/2015 | Miwa | C22C 38/001 75/246 |
| 2016/0284468 | A1 | 9/2016 | Yamagata et al. | |
| 2017/0025207 | A1 | 1/2017 | Nakajima et al. | |

FOREIGN PATENT DOCUMENTS

| | | | |
|---|---|---|---|
| JP | 05-047533 | A | 2/1993 |
| JP | 2007-266199 | A | 10/2007 |
| JP | 2011-211056 | A | 10/2011 |
| JP | 2014-027268 | A | 2/2014 |
| WO | 2013/008756 | A1 | 1/2013 |
| WO | 2013/191276 | A1 | 12/2013 |

OTHER PUBLICATIONS

Communication dated Mar. 28, 2018, from State Intellectual Property Office of the P.R.C. in counterpart application No. 201580049440.9.

International Search Report of PCT/JP2015/074777 dated Oct. 13, 2015.

* cited by examiner

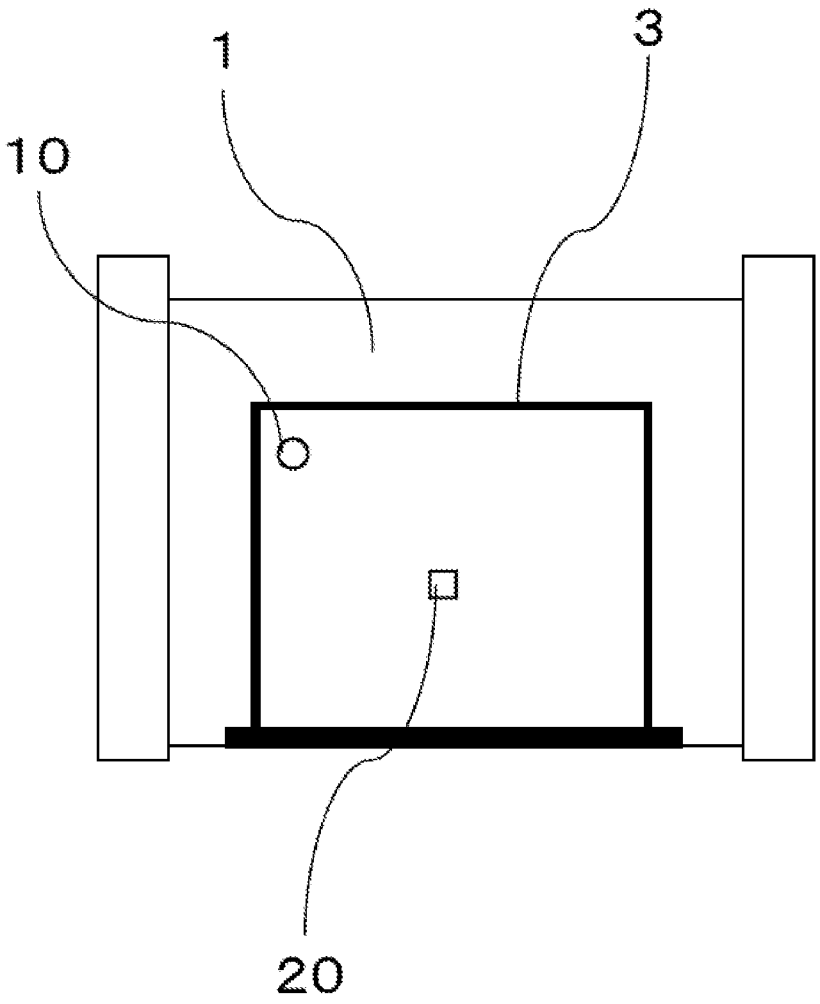
1
3
10
20

METHOD FOR MANUFACTURING R-T-B BASED SINTERED MAGNET

CROSS REFERENCE TO RELATED APPLICATIONS

This application is a National Stage of International Application No. PCT/JP2015/074777 filed Aug. 31, 2015 (claiming priority based on Japanese Patent Application No. 2014-188836 filed Sep. 17, 2014), the contents of which are incorporated herein by reference in their entirety.

TECHNICAL FIELD

The present disclosure relates to a method for manufacturing an R-T-B based sintered magnet.

BACKGROUND ART

An R-T-B based sintered magnet (where R is at least one of rare earth elements, indispensably containing Nd, and T is a transition metal element, indispensably containing Fe) that contains a $Nd_2Fe_{14}B$ compound as a main phase is known as a magnet with the highest performance among permanent magnets. Such a magnet is used in various motors for hybrid vehicles, electric vehicles, home appliances, etc.

The R-T-B based sintered magnet has its coercivity $H_{cJ}$ (hereinafter simply referred to as "$H_{cJ}$" in some cases) reduced at high temperatures, leading to irreversible thermal demagnetization. For this reason, R-T-B based sintered magnets applied in electric motors for hybrid vehicles or electric vehicles, which are potentially used in a relatively-high temperature environment, are required to have high $H_{cJ}$ values.

Conventionally, to improve $H_{cJ}$, a large amount of heavy rare earth element (mainly Dy) is added to the R-T-B based sintered magnet. However, this results in a problem that a residual magnetic flux density $B_r$ (hereinafter simply referred to as "$B_r$") is reduced. Because of this, in recent years, a method for obtaining high $H_{cJ}$ while suppressing the reduction in $B_r$ has been used in which a heavy rare earth element is diffused from the surface into the inside of a R-T-B based sintered magnet, causing the heavy rare earth element to be concentrated on an outer shell of the main phase crystal particle.

Dysprosium (Dy) has various issues, including inconsistent supply and large fluctuations in price because of restrictions on its resources. For this reason, a technique has been required to improve $H_{cJ}$ of an R-T-B based sintered magnet while reducing the use of heavy rare earth elements, such as Dy, as much as possible.

Patent Document 1 describes that the B content is set lower than that in the standard R-T-B based alloy, while at least one element selected from Al, Ga, and Cu is contained as a metal element M to thereby form an $R_2T_{17}$ phase, thus ensuring an adequate volume ratio of a transition metal-rich phase ($R_6T_{13}M$) generated using the $R_2T_{17}$ phase as a raw material, whereby an R-T-B based rare-earth sintered magnet with high coercivity can be produced while reducing the Dy content. Patent Document 2 describes that the B content is set lower than that in the standard R-T-B based alloy, while the contents of B, Al, Cu, Co, Ga, C, and O are controlled within predetermined ranges, and further an atomic ratio of Nd and Pr to B and an atomic ratio of Ga and C to B respectively satisfy specific relationships, which achieves the high residual magnetic flux density and coercivity.

CONVENTIONAL ART DOCUMENT

Patent Document

Patent Document 1: WO 2013/008756 A
Patent Document 2: WO 2013/191276 A

DISCLOSURE OF THE INVENTION

Problems to be Solved by the Invention

Meanwhile, there is still a strong need for an R-T-B based sintered magnet that exhibits higher $H_{cJ}$ than the $H_{cJ}$ achieved by the R-T-B based sintered magnets mentioned in Patent Documents 1 and 2. To meet such a need, some of the inventors have studied and found that in a grain boundary between two main phases (two-grain boundary), the formation of the transition metal-rich phase (R-T-Ga phase) mentioned in Patent Document 1 is suppressed (the amount generated is decreased) to form an R—Ga—Cu phase, thus enabling the production of an R-T-B based sintered magnet with higher $H_{cJ}$. (PCT International Application PCT/JP2014/071229)

To eliminate the $R_2T_{17}$ phase, it is necessary to form an R-T-Ga phase. However, to form an R—Ga—Cu phase by suppressing the formation of the R-T-Ga phase, an R-T-B based sintered magnet material with a predetermined composition (sintered body produced by sintering a molded body) is preferably subjected to heat treatment, namely, heating to a temperature of 730° C. or higher and 1,020° C. or lower. This is because the R-T-Ga phase is more likely to be formed at a temperature of 550° C. or higher and lower than 730° C. (or is less likely to be formed at 730° C. or higher), while the R—Ga—Cu phase is more likely to be formed at a temperature of 730° C. or higher and 1,020° C. or lower. In a sintering process (for example, in sintering at a temperature of 1,000 to 1,100° C.), to prevent oxidization of a molded body and to achieve adequate soaking during sintering, the molded body is generally accommodated in a metal container (sintering package) and is then subjected to the sintering in most settings. In such cases, it is difficult to control a cooling rate after the sintering, particularly, when seeking to obtain a high cooling rate. Consequently, after sintering, the sintered body is cooled at a relatively slow cooling rate in a temperature range of lower than 730° C. and 550° C. or higher, causing the formation of a large amount of the R-T-Ga phase, and possibly limiting the formation of the R—Ga—Cu phase.

Next, the R-T-B based sintered magnet material after the sintering (sintered body produced by sintering the molded body in order to obtain an R-T-B based sintered magnet) is heated to a temperature of, for example, 730° C. or higher and 1,020° C. or lower (high temperature), followed by rapid cooling (at a cooling rate of, for example, 40° C./min or more) (hereinafter, all these steps being collectively referred to as a "high-temperature rapid cooling process"). Subsequently, the magnet material is further subjected to a heat treatment that involves heating to a temperature of 440° C. or higher and 550° C. or lower. The inventors of the present application have found that in the way mentioned above, high $H_{cJ}$ is achieved (see PCT International Application PCT/JP2014/072920). This is considered to be because during the high-temperature rapid cooling process of the R-T-B based sintered magnet material, the heating at the high temperature eliminates the R-T-Ga phase generated during the cooling after the sintering, and the rapid cooling suppresses the further generation of the R-T-Ga phase, thereby enabling the formation of the R—Ga—Cu phase.

However, when in mass production of the R-T-B based sintered magnets, the amount of processing in one high-temperature rapid cooling process becomes extremely large, the required cooling rate cannot be obtained in some cases. When the high-temperature rapid cooling process is performed on the R-T-B based sintered magnet material by employing a heat treating furnace with a large processing capacity to counter this issue, the cooling rate of the R-T-B based sintered magnet material varies depending on the position of the magnet material within the furnace, resulting in a large difference in $H_{cJ}$ between a plurality of R-T-B based sintered magnets obtained in some cases. When performing the high-temperature rapid cooling process on a large-sized R-T-B based sintered magnet material to yield a larger R-T-B based sintered magnet, it is necessary to perform the cooling at a high rate so as to obtain the sufficient cooling rate even at the center of the R-T-B based sintered magnet material. This often causes cracking in the R-T-B based sintered magnet material due to thermal stress during the high-temperature rapid cooling process.

For this reason, a method is required that can manufacture an R-T-B based sintered magnet with high $H_{cJ}$ even after normal or slow cooling (e.g., at a cooling rate of 25° C./min or less) during the heat treatment without necessitating rapid cooling.

Embodiments of the present invention are adapted to meet these requirements. Accordingly, it is an object of the present disclosure to provide a method that can manufacture an R-T-B based sintered magnet with high $H_{cJ}$ without rapid cooling in a heat treatment process.

Means for Solving the Problems

A first aspect of the present invention is directed to a method for manufacturing an R-T-B based sintered magnet, which includes: 1) a step of preparing an R-T-B based sintered magnet material by sintering a molded body, the R-T-B based sintered magnet material including: 27.5% or more by mass and 34.0% or less by mass of R (R being at least one element of rare earth elements and indispensably containing Nd); 0.85% or more by mass and 0.93% or less by mass of B; 0.20% or more by mass and 0.70% or less by mass of Ga; more than 0.2% by mass and 0.50% or less by mass of Cu; 0.05% or more by mass and 0.5% or less by mass of Al; and 0% or more by mass and 0.1% or less by mass of M (M being one or both of Nb and Zr), with the balance being T (T being Fe and Co, and 90% or more of T in terms of mass ratio being Fe) and inevitable impurities, the R-T-B based sintered magnet material satisfying inequality expressions (1) and (2) below:

$$[T]-72.3[B]>0 \quad (1)$$

$$([T]-72.3[B])/55.85<13[Ga]/69.72 \quad (2)$$

where [T] is a T content in percent by mass, [B] is a B content in percent by mass, and [Ga] is a Ga content in percent by mass;

2) a high-temperature heat treatment step of heating the R-T-B based sintered magnet material to a heating temperature of 730° C. or higher and 1,020° C. or lower and then cooling the R-T-B based sintered magnet material to 300° C. at a cooling rate of 5° C./min or more; and 3) a low-temperature heat treatment step of heating the R-T-B based sintered magnet material after the high-temperature heat treatment step to 440° C. or higher and 550° C. or lower.

A second aspect of the present invention is directed to the method for manufacturing the R-T-B based sintered magnet according to the first aspect, wherein, in the step 2), the R-T-B based sintered magnet material is cooled from the heating temperature to 300° C. at a cooling rate of 5° C./min or more and 25° C./min or less.

A third aspect of the present invention is directed to the method for manufacturing the R-T-B based sintered magnet according to the first aspect, wherein, in the step 2), the R-T-B based sintered magnet material is cooled from the heating temperature to 300° C. at a cooling rate of 10° C./min or more and 25° C./min or less.

A fourth aspect of the present invention is directed to the method for manufacturing the R-T-B based sintered magnet according to any one of the first to third aspects, wherein, in the step 3), the R-T-B based sintered magnet material after the high-temperature heat treatment step is heated to a temperature of 450° C. or higher and 490° C. or lower.

A fifth aspect of the present invention is directed to the method for manufacturing the R-T-B based sintered magnet according to any ore of the first to fourth aspects, wherein the R-T-B based sintered magnet material includes 27.5% or more by mass and 31.0% or less by mass of R.

Effects of the Invention

In the present disclosure, it is possible to provide a method for manufacturing an R-T-B based sintered magnet with high $H_{cJ}$ without rapid cooling in a heat treatment process.

BRIEF DESCRIPTION OF THE DRAWINGS

FIG. 1 is a schematic plan view showing an arrangement position of a specimen within a heat treating furnace in a high-temperature heat treatment process.

MODE FOR CARRYING OUT THE INVENTION

The following embodiments are illustrative only to exemplify a method for manufacturing an R-T-B based sintered magnet to embody the technical concept of the present invention, and hence the present invention is not limited thereto. The size, material, shape, relative arrangement, etc., of each component mentioned in the embodiments are not intended to limit the scope of the present invention only thereto, unless otherwise specified, and further intended to exemplify the present invention. The size, positional relationship, and the like of members shown in some drawings are emphasized to make the contents easily understood.

The inventors have found that the content of copper (Cu) is restricted within a specific range (of more than 0.2% by mass and 0.50% or less by mass), thereby making it possible to obtain an R-T-B based sintered magnet that exhibits high $H_{cJ}$, even when the cooling from a heating temperature to 300° C. is moderate cooling (slow cooling) in a high-temperature heat treatment step. Here, the high-temperature heat treatment step involves applying a heat treatment by heating a sintered body to the heating temperature of 730° C. or higher and 1,020° C. or lower after the sintering. Based on these findings, the present invention has been made. Embodiments of the present invention will be described in detail below.

First, a description will be given on the mechanism for restricting the Cu content to more than 0.2% by mass and 0.50% or less by mass, thereby producing the R-T-B based sintered magnet that exhibits the high $H_{cJ}$ even when the cooling rate in the high-temperature heat treatment step is at a so-called slow-cooling level (e.g., 25° C./min or less). It should be noted that the following mechanism is one supposed by the inventors of the present application based on the findings currently obtained, and not intended to limit the scope of the present invention.

In the R-T-B based sintered magnet mentioned in Patent Document 1 or 2, a large amount of R-T-Ga phase (R-T-Ga phase includes 15% or more by mass and 65% or less by mass of R; 20% or more by mass and 80% or less by mass of T; and 2% or more by mass and 20% or less by mass of Ga. A typical example of the R-T-Ga phase is an $R_6T_{13}Ga_1$ compound. Note that since the R-T-Ga phase has inevitable impurities, such as Al and Si, trapped thereinto in some cases, the R-T-Ga compound is converted to form, for example, an $R_6T_{13}(Ga_{1-y-x}Al_ySi_z)$ compound in some cases) is formed when the cooling from the heating temperature in the high-temperature heat treatment step was moderate cooling (slow cooling), while the formation of the R—Ga—Cu phase (for example, $R_3(Ga, Cu)_1$ compound or $R_3(Ga, Cu, Co)_1$ compound, which would otherwise be configured by substituting Cu or a combination of Cu and Co for part of the R—Ga phase, and which would include: 70% or more by mass and 95% or less by mass of R; and 5% or more by mass and 30% or less by mass of Ga) is suppressed. (that is, the R—Ga—Cu phase is hardly formed in some cases.) Consequently, the sufficiently high $H_{cJ}$ cannot be obtained.

This is considered to be because once a large amount of R-T-Ga phase is formed, most of Ga is consumed to form the R-T-Ga phase, resulting in a decrease in the amount of Ga that is usable for formation of an R—Ga—Cu phase. Therefore, to form the R—Ga—Cu phase, it can be proposed to add a large amount of Ga. However, the inventors have found that when increasing the amount of addition of Ga, the R-T-Ga phase is formed preferentially over the R—Ga—Cu phase, leading to the formation of an excessive amount of the R-T-Ga, thus failing to obtain the high $H_{cJ}$.

The inventors have further studied and considered the following. In detail, Cu is less likely to be substituted for Ga in the R-T-Ga phase, but is more likely to be substituted for Ga in the R—Ga—Cu phase. By adding a large amount of Cu, the R—Ga—Cu phase will be able to be formed more without excessively generating the R-T-Ga phase, even if any R-T-Ga phase is formed in the moderate cooling (slow cooling) of the high-temperature processing process, unlike the case of adding a large amount of Ga as mentioned above. Furthermore, the inventors have found that by setting the Cu content at more than 0.2% by mass and also setting the upper limit of the Cu content at 0.50% by mass to prevent degradation in the magnetic properties, the R—Ga—Cu phase can be formed while suppressing the formation of the R-T-Ga phase even when cooing in the high-temperature heat treatment step is performed not only at a rapid cooling level (e.g., 40° C./min or more), but also at a slow-cooling level of 5° C./min or more. In this way, the R-T-B based sintered magnet with the high $H_{cJ}$ can be obtained, which leads to the embodiments of the present invention.

The respective steps in the method for manufacturing an R-T-B based sintered magnet according to the embodiments of the present invention will be described in detail below.

1. Preparation Step for R-T-B Based Sintered Magnet Material

The term "R-T-B based sintered magnet material" as used herein means a sintered body obtained by sintering a molded body. In this step, the R-T-B based sintered magnet material that is a sintered magnet material with a predetermined composition is obtained. The obtained R-T-B based sintered magnet material is subjected to a heat treatment that includes a high-temperature heat treatment step and a low-temperature heat treatment step, which are to be mentioned later.

Note that the following step exemplifies a step of preparing the R-T-B based sintered magnet material and is illustrative only. Thus, the R-T-B based sintered magnet material may be prepared by any method as long as it can produce a sintered body for an R-T-B based sintered magnetic with the predetermined composition.

First, metals or alloys (melted raw materials) for respective elements are prepared such that the R-T-B based sintered magnet material has the composition to be mentioned in detail below, and then the prepared metals or alloys are processed by a strip casting method or the like to thereby fabricate a flake raw-material alloy. Then, an alloy powder is produced from the flake raw-material alloy. Subsequently, the alloy powder is formed into a molded body. The thus-obtained molded body is sintered, so that the R-T-B based sintered magnet material is prepared.

The production of the alloy powder and the formation and sintering of the molded body are performed by way of example as follows.

The obtained flake raw-material alloy is subjected to hydrogen pulverization, thereby producing coarse pulverized particles, each having a size of 1.0 mm or less. Then, the coarse pulverized particles are further pulverized finely by a jet mill or the like in an inert gas, thereby producing a fine pulverized powder (alloy powder) having a particle size $D_{50}$ of 3 to 5 μm (which is a volume central value (volume-based median diameter) obtained by measurement in an airflow dispersion laser diffraction method). The alloy powder may be one kind of alloy powder (single alloy powder) or a mixture of two or more kinds of alloy powders (mixed alloy powder) obtained by the so-called two-alloy method. The alloy powder may be fabricated by any well-known method to have the composition specified by the embodiments of the present invention.

A well-known lubricant may be respectively added as an auxiliary agent to the coarse pulverized powder before the jet mill pulverization and to the alloy powder during and after the jet mill pulverization. Then, the thus-obtained alloy powder is formed under a magnetic field, thereby producing a molded body. The forming may be performed by arbitrary well-known forming methods, which include a dry forming method in which dry alloy powder is inserted into a cavity of a die and compressed, and a wet forming method in which a slurry containing an alloy powder is charged into a cavity of a die, and a dispersion medium of the slurry is discharged therefrom, thereby producing a molded body by using the remaining alloy powder.

Such a molded body is sintered to thereby produce the R-T-B based sintered magnet material. Sintering of the molded body can be done by the well-known methods. Note that to prevent oxidization in an atmosphere during the sintering, the sintering is preferably performed in a vacuum atmosphere or atmosphere gas. The atmosphere gas preferably uses inert gases, such as helium or argon.

The composition of the R-T-B based sintered magnet material will be described below.

The R-T-B based sintered magnet material according to the embodiment of the present invention includes: 27.5% or more by mass and 34.0% or less by mass of R (where R is at least one of rare earth elements and indispensably contains Nd); 0.85% or more by mass and 0.93% or less by mass of B; 0.20% or more by mass and 0.70% or less by mass of Ga; more than 0.2% by mass and 0.50% or less by mass of Cu; 0.05% or more by mass and 0.5% or less by mass of Al;

and 0% or more by mass and 0.1% or less by mass of M (where M is one or both of Nb and Zr), with the balance being T and inevitable impurities (where T is Fe and Co, with 90% or more in terms of mass ratio being Fe). The R-T-B based sintered magnet material satisfies inequality expressions (1) and (2) below:

$$[T]-72.3[B]>0 \quad (1)$$

$$([T]-72.3[B])/55.85<13[Ga]/69.72 \quad (2)$$

where [T] is a T content in percent by mass, [B] is a B content in percent by mass, and [Ga] is a Ga content in percent by mass.

The R-T-B based sintered magnet (R-T-B based sintered magnet material) in the embodiment of the present invention may contain inevitable impurities. Even if the R-T-B based sintered magnet contains inevitable impurities, which normally tend to be trapped in a melted raw material, for example, a didymium alloy (Nd—Pr), an electrolytic iron, ferroboron, etc., the effects of the present invention can be exhibited. Examples of the inevitable impurities include La, Ce, Cr, Mn, Si, etc.

With the above-mentioned composition, the B content is set lower than that of the general R-T-B based sintered magnet, and further Ga or the like is contained, whereby in a state after the sintering (in a state before the high-temperature heat treatment to be mentioned later), an R-T-Ga phase is generated in the grain boundary, such as a two-grain boundary, like Patent Documents 1 to 2 mentioned above. Furthermore, the R-T-B based sintered magnet contains the sufficient amount of Cu, whereby the formation of the R-T-Ga phase can be suppressed even when the cooling in the high-temperature heat treatment is moderate cooling. Moreover, a low-temperature heat treatment to be mentioned in detail below is performed after the high-temperature heat treatment, so that the sufficient amount of the R—Ga—Cu phase can be formed in the two-grain boundary, and consequently, the high $H_{cJ}$ can be obtained even when the content of a heavy rare earth element, such as Dy, is small.

The details of the respective elements will be described below.

1) Rare Earth Elements (R)

R in the R-T-B based sintered magnet according to the embodiment of the present invention is at least one of rare earth elements, and indispensably contains Nd. The R-T-B based sintered magnet according to the embodiment of the present invention can exhibit high $B_r$ and high $H_{cJ}$ even when a heavy rare earth element (RH) is not contained therein. Thus, even when the higher $H_{cJ}$ is required, the amount of added RH can be reduced and typically can be reduced to 5% or less by mass. However, this does not mean that the RH content in the R-T-B based sintered magnet according to the embodiment of the present invention is limited to 5% or less by mass.

When the R content is less than 27.5% by mass, the R required to form the R—Ga—Cu phase cannot be ensured, which might fail to obtain the high $H_{cJ}$. When the R content exceeds 34.0% by mass, the ratio of the main phase is reduced, failing to obtain the high $B_r$. The R content is preferably 31.0% or less by mass to obtain the higher $B_r$.

2) Boron (B)

When the B content is less than 0.85% by mass, an $R_2T_{17}$ phase is precipitated, failing to obtain the high $H_{cJ}$. Furthermore, the ratio of the main phase is reduced, failing to obtain the high $B_r$. When the B content exceeds 0.93% by mass, the amount of formed R-T-Ga phase is so small that the high $H_{cJ}$ might not be obtained.

3) Transition Metal Element (T)

T includes Fe and Co, with 90% or more of T in terms of mass ratio being Fe. Furthermore, as inevitable impurities, a small amount of transition metal elements, such as V, Mo, Hf, Ta, or W, may be contained. When the ratio of Fe to T in terms of mass ratio is less than 90%, $B_r$ might be drastically degraded. An example of another transition metal element other than Fe includes, for example, Co. Note that the amount of substitution of Co is preferably 2.5% or less in the total T in terms of mass ratio. When the amount of substitution of Co exceeds 10% in the total T in terms of mass ratio, $B_x$ is degraded, which is not preferable.

4) Gallium (Ga)

When the Ga content is less than 0.2% by mass, the formation amounts of the R-T-Ga phase and the R—Ga—Cu phase become extremely small, whereby the $R_2T_{17}$ phase cannot be eliminated, thus failing to obtain the high $H_{cJ}$. When the Ga content exceeds 0.7% by mass, unnecessary Ga is present, and thereby the ratio of the main phase might be decreased, leading to the reduction in $B_r$.

5) Copper (Cu)

When the Cu content is 0.2% or less by mass, the R—Ga—Cu phase is hardly formed if rapid cooling (e.g., 40° C./min) is not performed in the high-temperature heat treatment step to be mentioned later, so that the high $H_{cJ}$ cannot be obtained. When the Cu content exceeds 0.5% by mass, the ratio of the main phase is reduced, resulting in a decrease in the $B_r$.

6) Aluminum (Al)

The Al content is set at 0.05% or more by mass and 0.5% or less by mass. Al is contained in the R-T-B based sintered magnet, so that the $H_{cJ}$ can be improved. Al may be contained as an inevitable impurity, or alternatively may be positively added. The total amount of Al contained as the inevitable impurity and positively added is set at 0.05% or more by mass and 0.5% or less by mass.

7) Niobium (Nb) and Zirconium (Zr)

In general, the R-T-B based sintered magnet is known to more surely suppress the abnormal growth of crystal grains during sintering by containing one or both of Nb and Zr. Also, in the embodiment of the present invention, the R-T-B based sintered magnet may contain 0.1% or less by mass in total of Nb and/or Zr. When the total content of Nb and/or Zr exceeds 0.1% by mass, unnecessary Nb and Zr are present, and thereby the ratio of the main phase might be decreased, leading to the reduction in $B_r$.

8) Inequality Expressions (1) and (2)

The composition of the R-T-B based sintered magnet material in the embodiment of the present invention satisfies the inequality expressions (1) and (2), so that the B content is set lower than that of a general R-T-B based sintered magnet. The general R-T-B based sintered magnet is designed to have the composition in which [Fe]/55.847 (atomic weight of Fe) is smaller than [B]/10.811 (atomic weight of B)×14 in order to prevent the precipitation of a soft magnetic phase of $R_2T_{17}$ phase other than the main phase of $R_2T_{14}B$ phase ([ ] means a content of an element mentioned inside the parentheses in percent by mass. For example, [Fe] means a content of Fe in percent by mass.) Unlike the general R-T-B based sintered magnet, the R-T-B based sintered magnet according to the embodiment of the present invention is configured to have the composition that satisfies the inequality expression (1) such that [Fe]/55.847 (atomic weight of Fe) is larger than [B]/10.811 (atomic weight of B)×14. Furthermore, the R-T-B based sintered magnet in the embodiment of the present invention is configured to have the composition that satisfies the inequality expression (2) such that ([T]−72.3B)/55.85 (atomic weight of Fe) is smaller than 13Ga/69.72 (atomic weight of Ga) in order to precipitate the R-T-Ga phase by containing Ga without precipitating the $R_2T_{17}$ phase from excess Fe. The R-T-B based sintered magnet material is adapted to have the composition that satisfies the above-mentioned inequality expressions (1) and (2), and to be subjected to the high-temperature heat treatment step to be mentioned later, so that the R—Ga—Cu phase can be formed without excessively forming the R-T-Ga phase. Note that although T includes Fe and Co, in the embodiment of the present invention, Fe is a main component (in a content of 90% or more in terms of mass ratio) in T. This is why the atomic weight of Fe is used. With this arrangement, the R-T-B based sintered magnet in the present invention can achieve the high $H_{cJ}$ while reducing the use of the heavy rare earth element, such as Dy, as much as possible.

$$[T]-72.3[B]>0 \quad (1)$$

$$([T]-72.3[B])/55.85<13[Ga]/69.72 \quad (2)$$

where [T] is a T content in percent by mass, [B] is a B content in percent by mass, and [Ga] is a Ga content in percent by mass.

2. High-Temperature Heat Treatment Step

The obtained R-T-B based sintered magnet material was heated to a temperature of 730° C. or higher and 1,020° C. or lower, and then cooled to 300° C. at a cooling rate of 5° C./min or more. In the embodiments of the present invention, this heat treatment is hereinafter referred to as the "high-temperature heat treatment step". The R-T-B based sintered magnet material according to the embodiment of the present invention that contains a predetermined content of Cu is subjected to the high-temperature heat treatment, thereby making it possible to form the R—Ga—Cu phase mainly at a grain boundary multiple point (a part located as a boundary among three or more main phases) without excessively forming the R-T-Ga phase.

When the heating temperature in the high-temperature heat treatment step is lower than 730° C., as the temperature is extremely low, a sufficient amount of R—Ga—Cu phase might not be possibly formed, and the R-T-Ga phase generated in the sintered process is not eliminated, causing the R-T-Ga phase to excessively remain after the high-temperature heat treatment step, thus failing to obtain the high $H_{cJ}$. When the heating temperature exceeds 1,020° C., the grain growth of the main phase occurs drastically, which might reduce the $H_{cJ}$. The holding time at the heating temperature is preferably 5 minutes or more and 500 minutes or less.

If the cooling rate to 300° C. is less than 5° C./min after heating (and holding) the R-T-B based sintered magnet material at the heating temperature of 730° C. or higher and 1,020° C. or lower, the R-T-Ga phase might be excessively formed.

As mentioned above, suppose that an R-T-B based sintered magnet has Ga or the like added thereto and has a B content set lower than that in the general R-T-B based sintered magnet. Such an R-T-B based sintered magnet will have a large amount of R-T-Ga phase formed therein almost without containing an R—Ga—Cu phase unless it is subjected to rapid cooling (for example, at a cooling rate of 40° C./min or more) after being held at the heating temperature in the high-temperature heat treatment step. However, the R-T-B based sintered magnet according to the embodiment of the present invention that sets the Cu content within the predetermined range can have the sufficient amount of R—Ga—Cu phase formed therein, while suppressing the formation of the R-T-Ga phase even when the cooling in the high-temperature heat treatment step is slow cooling (e.g., at 25° C./min or less), so that the high $H_{cJ}$ can be obtained.

That is, in the high-temperature heat treatment according to the embodiment of the present invention, the cooling rate from the heating temperature of 730° C. or higher and 1,020° C. or lower to a temperature of 300° C. may be 5° C./min or more. This means that the cooling may be rapid cooling (at a cooling rate of, for example, 30° C./min or more), or slow cooling (at a cooling rate of, for example, 25° C./min or less) as needed (for instance, to prevent the occurrence of cracks due to thermal stress when intended to obtain the larger-sized R-T-B based sintered magnet). Preferably, the cooling rate is 5° C./min or more and 25° C./min or less. Such moderate cooling (slow cooling) at a cooling rate of 5° C./min or more and 25° C./min or less eliminates variations in the cooling rate depending on the mounting position of the sintered magnetic magnet material when using a heat treating furnace with a large capacity, which is generally employed as a production equipment. Thus, variations in the $H_{cJ}$ of the sintered magnet depending on the mounting position can be suppressed to thereby obtain the high $H_{cJ}$. The cooling rate is more preferably 10° C./min or more and 25° C./min or less. Accordingly, the sintered magnet can achieve the higher $B_r$ and $H_{cJ}$ while suppressing variations in the $H_{cJ}$ depending on the mounting position thereof.

The cooling rate from the heating temperature of 730° C. or higher and 1,020° C. or lower to 300° C. after heating may be varied while the cooling proceeds from the heating temperature to 300° C. For example, immediately after the start of cooling, the cooling rate may be approximately 10° C./min and may be changed to 5° C./min or the like as the temperature of the sintered magnet material approaches 300° C.

A method for cooling the R-T-B based sintered magnet material from the heating temperature of 730° C. or higher and 1,020° C. or lower to the temperature of 300° C. at a cooling rate of 5° C./min or more may involve cooling, for example, by introducing argon gas in a furnace. However, other arbitrary methods may be employed.

Note that a method for evaluating the cooling rate from the heating temperature of 730° C. or higher and 1,020° C. or lower after heating to 300° C. in use may involve evaluating an average cooling rate from the heating temperature to 300° C. (that is, a value obtained by dividing a temperature difference between the heating temperature and 300° C. by a time during which the temperature is decreased from the heating temperature to 300° C.).

As mentioned above, the R-T-B based sintered magnet according to the embodiment of the present invention is configured to suppress the formation of the R-T-Ga phase, and thereby contains the sufficient amount of the R—Ga—Cu phase. To obtain the high $H_{cJ}$, as mentioned above, it is very important to form the R—Ga—Cu phase while suppressing the formation of the R-T-Ga phase as much as possible, even though the presence of the R-T-Ga phase is necessary. Therefore, in the R-T-B based sintered magnet according to the embodiment of the present invention, the formation of the R-T-Ga phase needs only to be suppressed to an extent that can produce the sufficient amount of R—Ga—Cu phase. Thus, some amount of R-T-Ga phase may be present.

3. Low-Temperature Heat Treatment Step

The R-T-B based sintered magnet material obtained after the high-temperature heat treatment step is heated to a temperature of 440° C. or higher and 550° C. or lower. In this embodiment of the present invention, this heat treatment is herein referred to as the "low-temperature heat treatment step". The low-temperature heat treatment step is performed to enable the formation of the sufficient amount of the R—Ga—Cu phase in the two-grain boundary, while suppressing the formation of the R-T-Ga phase. This is considered to result in high $H_{cJ}$.

When the temperature in the low-temperature heat treatment step (heating temperature of the low-temperature heat treatment) is lower than 440° C., the R-T-Ga phase might not be formed sufficiently, and further the sufficient amount of the R—Ga—Cu might not be possibly present at the two-grain boundary. When the heating temperature of the low-temperature heat treatment exceeds 550° C., the amount of formed R-T-Ga phase might become excessive. The heating temperature of the low-temperature heat treatment is preferably 450° C. or higher and 490° C. or lower. The holding time at the heating temperature is preferably 5 minutes or more and 500 minutes or less. The cooling rate after the heating to the temperature of 440° C. or higher and 550° C. or lower may be an arbitrary cooling rate.

The obtained R-T-B based sintered magnet may be subjected to machining, such as grinding, to adjust the size of the magnet. In this case, each of the high-temperature heat treatment step and the low-temperature heat treatment step may be performed either before or after the machining. Furthermore, the obtained sintered magnet may be subjected to a surface treatment. The surface treatment may be the well-known surface treatment. For example, the surface treatment, such as an Al vapor deposition, nickel (Ni) electroplating, or resin coating, can be performed.

EXAMPLES

Example 1

An Nd metal, a Pr metal, a Dy metal, a ferroboron alloy, an electrolytic Co, an Al metal, a Cu metal, a Ga metal, a ferrozirconium alloy, and an electrolytic iron (each of these metals having a purity of 99% or more) were blended so as to have a predetermined composition. These raw materials were melted and casted by the strip casting method, thereby producing a flake raw-material alloy having a thickness of 0.2 to 0.4 mm. The obtained flake raw-material alloy was subjected to hydrogen embrittlement under a hydrogen pressurized atmosphere, and a dehydrogenation process was performed on the alloy by heating to 550° C. in vacuum and then cooling, thereby producing coarse pulverized powder. Then, 0.04% by mass of a zinc stearate was added as a lubricant and mixed into 100% by mass of the coarse pulverized powder obtained, followed by dry pulverization under an airflow of nitrogen gas using the airflow pulverizer (jet mill device), thereby producing fine pulverized powder (alloy powder) having a grain size D50 of 4 μm. The grain size D50 is a volume-based median diameter obtained by a laser diffraction method using the airflow dispersion method.

Then, 0.04% by mass of a fatty acid ester was added as a lubricant and mixed into 100% by mass of the fine pulverized powder, followed by molding the powder under a magnetic field, thereby producing a molded body. Note that as the molding device, a so-called orthogonal magnetic field molding device (lateral magnetic field molding device) was used in which a magnetic-field application direction was orthogonal to a pressure application direction.

The obtained molded body was sintered at 1,020° C. for four hours in vacuum, thereby producing the R-T-B based sintered magnet material. The R-T-B based sintered magnet material had a size of 20 mm in length, 20 mm in width, and 20 mm in thickness, and a density of 7.5 $Mg/m^3$ or more. Table 1 shows the result of component analysis on the obtained R-T-B based sintered magnet material (including the results of gas analysis on O, C, and N). Note that among these components shown in Table 1, Nd, Pr, Dy, B, Co, Al, Cu, Ga, Nb, Zr, and Fe were analyzed with a high-frequency inductively coupled plasma emission spectroscopy (ICP-OES). O (oxygen amount) was measured by a gas analyzer using a gas melting-infrared absorption method; N (nitrogen amount) was measured by a gas analyzer using a gas melting-heat conduction method; and C (carbon amount) was measured by a gas analyzer using a combustion-infrared absorption method.

TABLE 1

| Magnet material | Results of analysis on R—T—B based sintered magnet material (% by mass) | | | | | | | | | | | | | | Inequality expression | Inequality expression |
|---|---|---|---|---|---|---|---|---|---|---|---|---|---|---|---|---|
| No . | Nd | Pr | Dy | B | Co | Al | Cu | Ga | Nb | Zr | Fe | O | N | C | 1 | 2 |
| A | 22.82 | 7.62 | 0.00 | 0.90 | 0.90 | 0.22 | 1.00 | 0.48 | 0.00 | 0.00 | 65.84 | 0.10 | 0.03 | 0.08 | ○ | ○ |
| B | 22.68 | 7.60 | 0.00 | 0.89 | 0.91 | 0.22 | 0.62 | 0.48 | 0.00 | 0.00 | 66.38 | 0.11 | 0.03 | 0.07 | ○ | ○ |
| C | 22.73 | 7.58 | 0.00 | 0.90 | 0.91 | 0.22 | 0.50 | 0.48 | 0.00 | 0.00 | 66.48 | 0.11 | 0.03 | 0.07 | ○ | ○ |
| D | 24.67 | 8.19 | 0.00 | 0.88 | 0.89 | 0.22 | 0.28 | 0.63 | 0.00 | 0.00 | 63.78 | 0.39 | 0.01 | 0.07 | ○ | ○ |
| E | 23.83 | 7.90 | 0.00 | 0.89 | 0.89 | 0.22 | 0.27 | 0.61 | 0.00 | 0.00 | 64.92 | 0.39 | 0.01 | 0.07 | ○ | ○ |
| F | 22.72 | 7.58 | 0.00 | 0.89 | 0.91 | 0.21 | 0.27 | 0.49 | 0.00 | 0.00 | 66.70 | 0.13 | 0.03 | 0.08 | ○ | ○ |
| G | 23.77 | 7.89 | 0.00 | 0.89 | 0.89 | 0.23 | 0.27 | 0.39 | 0.00 | 0.00 | 65.21 | 0.38 | 0.01 | 0.07 | ○ | ○ |
| H | 22.70 | 7.41 | 0.00 | 0.89 | 0.88 | 0.11 | 0.25 | 0.56 | 0.00 | 0.10 | 66.92 | 0.08 | 0.03 | 0.07 | ○ | ○ |
| I | 22.80 | 7.65 | 0.00 | 0.90 | 0.88 | 0.12 | 0.22 | 0.47 | 0.00 | 0.10 | 66.69 | 0.07 | 0.04 | 0.07 | ○ | ○ |
| J | 22.16 | 7.62 | 2.67 | 0.88 | 0.88 | 0.20 | 0.22 | 0.38 | 0.00 | 0.00 | 64.53 | 0.37 | 0.01 | 0.08 | ○ | ○ |
| K | 20.45 | 6.94 | 4.93 | 0.88 | 0.90 | 0.23 | 0.22 | 0.39 | 0.00 | 0.00 | 64.58 | 0.36 | 0.02 | 0.10 | ○ | ○ |
| L | 20.10 | 6.56 | 6.45 | 0.88 | 0.90 | 0.20 | 0.21 | 0.45 | 0.00 | 0.00 | 63.79 | 0.38 | 0.01 | 0.07 | ○ | ○ |
| M | 23.67 | 7.82 | 0.00 | 0.90 | 0.90 | 0.23 | 0.15 | 0.37 | 0.00 | 0.00 | 65.48 | 0.42 | 0.01 | 0.07 | x | ○ |
| N | 23.75 | 7.86 | 0.00 | 0.90 | 0.89 | 0.22 | 0.15 | 0.50 | 0.00 | 0.00 | 65.26 | 0.40 | 0.01 | 0.07 | x | ○ |
| O | 22.59 | 7.45 | 0.00 | 0.90 | 0.91 | 0.20 | 0.10 | 0.48 | 0.00 | 0.00 | 67.15 | 0.12 | 0.03 | 0.08 | ○ | ○ |
| P | 22.70 | 7.59 | 0.00 | 0.89 | 0.91 | 0.22 | 0.00 | 0.50 | 0.00 | 0.00 | 67.00 | 0.10 | 0.03 | 0.07 | ○ | ○ |
| Q | 22.66 | 7.47 | 0.00 | 0.93 | 0.90 | 0.21 | 0.50 | 0.48 | 0.00 | 0.00 | 66.63 | 0.11 | 0.03 | 0.08 | x | ○ |
| R | 22.69 | 7.56 | 0.00 | 0.85 | 0.91 | 0.21 | 0.27 | 0.42 | 0.00 | 0.00 | 66.85 | 0.13 | 0.03 | 0.08 | ○ | x |
| S | 22.70 | 7.74 | 0.00 | 0.95 | 0.88 | 0.11 | 0.25 | 0.56 | 0.10 | 0.00 | 66.53 | 0.08 | 0.03 | 0.07 | x | ○ |
| T | 22.73 | 7.58 | 0.00 | 0.84 | 0.91 | 0.21 | 0.27 | 0.65 | 0.00 | 0.00 | 66.59 | 0.12 | 0.03 | 0.07 | ○ | ○ |
| U | 22.75 | 7.59 | 0.00 | 0.89 | 0.91 | 0.20 | 0.27 | 0.74 | 0.00 | 0.00 | 66.41 | 0.12 | 0.04 | 0.08 | ○ | ○ |

The obtained R-T-B based sintered magnet materials were subjected to the high-temperature heat treatment step on the conditions shown in Table 2. A specimen No. 1 shown in Table 2 used an R-T-B based sintered magnet material made of magnet material No. A shown in Table 1. The specimen No. 1 was heated to a heating temperature of 800° C., and then cooled from the heating temperature (800° C.) to 300° C. at an average cooling rate of 50° C./min, and further cooled from 300° C. to the room temperature at an average cooling rate of 3° C./min. Note that in the high-temperature heat treatment step, a heating holding time was 3 hours for all specimens. Thus, the specimen No. 1 was heated to 800° C. and held at this temperature for 3 hours. Also in the specimens Nos. 2 to 52, R-T-B based sintered magnet materials Nos. corresponding to the respective specimens Nos. shown in Table 2 were subjected to the high-temperature heat treatment on the conditions (temperature and cooling rate) for the high-temperature heat treatment step set for the respective specimens Nos shown in Table 2.

Note that in the high-temperature heat treatment step, an average cooling rate from 300° C. to the room temperature was set at 3° C./min for each of the specimens Nos. 2 to 52, like the specimen No. 1. Thereafter, each R-T-B based sintered magnet material obtained after the high-temperature heat treatment was subjected to the low-temperature heat treatment step at the temperature shown in Table 2. For each of the specimens, in the low-temperature heat treatment step, a heating holding time was set at 2 hours, and the cooling was performed at a cooling rate of 2° C./min from the holding temperature to the room temperature. Thus, for example, the specimen No. 1 was heated to 470° C. and held at this temperature for 2 hours, followed by cooling to the room temperature at a cooling rate of 2° C./min. The heating temperature and cooling rate in each of the high-temperature heat treatment step and the low-temperature heat treatment step were measured by installing a thermocouple on the R-T-B based sintered magnet material. The R-T-B based sintered magnet of each specimen obtained after the low-temperature heat treatment step was machined to produce one with 7 mm in length, 7 mm in width, and 7 mm in thickness. Then, $B_r$ and $H_{cJ}$ of each specimen were measured by a B—H tracer. The measurement results are shown in Table 2. Note that the R-T-B based sintered magnet of each specimen after measuring its $B_r$ and $H_{cJ}$ was evaluated for the component analysis and gas analysis. The results of the component and gas analysis of the R-T-B based sintered magnet were the same as those shown in Table 1.

Furthermore, regarding the same R-T-B based sintered magnet material (the same magnet material No. shown in Table 2), a difference in the $H_{cJ}$ between the R-T-B based sintered magnet material subjected to the rapid cooling (50° C./min) and the same kind of the R-T-B based sintered magnet material subjected to slow cooling (5° C./min) in the high-temperature heat treatment step was determined (the $H_{cJ}$ means $H_{cJ}$ of the R-T-B based sintered magnet after the low-temperature heat treatment step). That is, if the difference in $H_{cJ}$ between the rapid cooling and slow cooling is small, the cooling rate in the high-temperature heat treatment step can be made slow. On the other hand, if the difference is large, the cooling rate in the high-temperature heat treatment step cannot be moderate. These results are shown in the item $\Delta H_{cJ}$ of Table 2. Note that the specimens Nos. 48 to 52 were cooled only at a cooling rate of 50° C./min after the heat treatment at a high temperature, and thus there is no description about $\Delta H_{cJ}$ for these specimens.

TABLE 2

| | High-temperature heat treatment step | | Low-temperature heat treatment step | Magnetic properties | | | | |
|---|---|---|---|---|---|---|---|---|
| Specimen No. | Temperature (° C.) | Cooling rate (° C./min) | Temperature (° C.) | Br (T) | $H_{cJ}$ (kA/m) | Magnet material No. | $\Delta H_{cJ}$ (kA/m) | Note |
| 1 | 800 | 50 | 470 | 1.358 | 1,320 | A | 77 | Comparative Example |
| 2 | 800 | 23 | 470 | 1.362 | 1,314 | | | Comparative Example |
| 3 | 800 | 16 | 470 | 1.359 | 1,280 | | | Comparative Example |
| 4 | 800 | 5 | 470 | 1.361 | 1,243 | | | Comparative Example |
| 5 | 800 | 50 | 470 | 1.365 | 1,374 | B | 51 | Comparative Example |
| 6 | 800 | 23 | 470 | 1.364 | 1,352 | | | Comparative Example |
| 7 | 800 | 16 | 470 | 1.368 | 1,335 | | | Comparative Example |
| 8 | 800 | 5 | 470 | 1.367 | 1,323 | | | Comparative Example |
| 9 | 800 | 50 | 470 | 1.376 | 1,415 | C | 34 | Example |
| 10 | 800 | 23 | 470 | 1.366 | 1,413 | | | Example |
| 11 | 800 | 16 | 470 | 1.375 | 1,392 | | | Example |
| 12 | 800 | 5 | 470 | 1.380 | 1,381 | | | Example |
| 13 | 800 | 3 | 470 | 1.377 | 1,250 | | | Comparative Example |
| 14 | 800 | 50 | 470 | 1.300 | 1,502 | D | 17 | Example |
| 15 | 800 | 5 | 470 | 1.302 | 1,485 | | | Example |
| 16 | 800 | 50 | 470 | 1.327 | 1,468 | E | 44 | Example |
| 17 | 800 | 5 | 470 | 1.323 | 1,424 | | | Example |
| 18 | 800 | 3 | 470 | 1.313 | 1,246 | | | Comparative Example |
| 19 | 800 | 50 | 470 | 1.384 | 1,430 | F | 22 | Example |
| 20 | 800 | 23 | 470 | 1.386 | 1,445 | | | Example |
| 21 | 800 | 16 | 470 | 1.380 | 1,414 | | | Example |
| 22 | 800 | 5 | 470 | 1.382 | 1,408 | | | Example |
| 23 | 800 | 50 | 470 | 1.335 | 1,435 | G | 27 | Example |
| 24 | 800 | 5 | 470 | 1.332 | 1,408 | | | Example |
| 25 | 800 | 50 | 490 | 1.392 | 1,416 | H | 8 | Example |
| 26 | 800 | 5 | 490 | 1.392 | 1,408 | | | Example |
| 27 | 800 | 50 | 490 | 1.385 | 1,461 | I | 38 | Example |
| 28 | 800 | 5 | 490 | 1.383 | 1,423 | | | Example |
| 29 | 800 | 50 | 470 | 1.306 | 1,772 | J | 9 | Example |
| 30 | 800 | 5 | 470 | 1.298 | 1,736 | | | Example |
| 31 | 800 | 50 | 490 | 1.249 | 2,185 | K | 51 | Example |
| 32 | 800 | 5 | 490 | 1.249 | 2,134 | | | Example |

TABLE 2-continued

| Specimen No. | High-temperature heat treatment step: Temperature (° C.) | High-temperature heat treatment step: Cooling rate (° C./min) | Low-temperature heat treatment step: Temperature (° C.) | Magnetic properties: Br (T) | Magnetic properties: $H_{cJ}$ (kA/m) | Magnet material No. | $\Delta H_{cJ}$ (kA/m) | Note |
|---|---|---|---|---|---|---|---|---|
| 33 | 800 | 50 | 490 | 1.179 | 2,500 | L | 41 | Example |
| 34 | 800 | 5 | 490 | 1.179 | 2,459 | | | Example |
| 35 | 800 | 3 | 490 | 1.176 | 2,173 | | | Comparative Example |
| 36 | 800 | 50 | 470 | 1.345 | 1,411 | M | 179 | Comparative Example |
| 37 | 800 | 5 | 470 | 1.334 | 1,232 | | | Comparative Example |
| 38 | 800 | 50 | 470 | 1.336 | 1,443 | N | 221 | Comparative Example |
| 39 | 800 | 5 | 470 | 1.324 | 1,222 | | | Comparative Example |
| 40 | 800 | 50 | 470 | 1.392 | 1,405 | O | 233 | Comparative Example |
| 41 | 800 | 23 | 470 | 1.391 | 1,437 | | | Comparative Example |
| 42 | 800 | 16 | 470 | 1.397 | 1,323 | | | Comparative Example |
| 43 | 800 | 5 | 470 | 1.397 | 1,172 | | | Comparative Example |
| 44 | 800 | 50 | 470 | 1.350 | 1,110 | P | 228 | Comparative Exatnple |
| 45 | 800 | 23 | 470 | 1.332 | 1,012 | | | Comparative Example |
| 46 | 800 | 16 | 470 | 1.311 | 963 | | | Comparative Example |
| 47 | 800 | 5 | 470 | 1.323 | 882 | | | Comparative Example |
| 48 | 800 | 50 | 470 | 1.403 | 1,138 | Q | — | Comparative Example |
| 49 | 800 | 50 | 470 | 1.388 | 1,332 | R | — | Comparative Example |
| 50 | 800 | 50 | 490 | 1.414 | 1,120 | S | — | Comparative Example |
| 51 | 800 | 50 | 470 | 1.354 | 1,442 | T | — | Comparative Example |
| 52 | 800 | 50 | 470 | 1.349 | 1,464 | U | — | Comparative Example |

As shown in Table 2, samples in Examples (specimens Nos. 9 to 12, 14 to 17, and 19 to 34) were obtained by respectively applying the high-temperature heat treatment step and the low-temperature heat treatment step according to the embodiment of the present invention, to the R-T-B based sintered magnet materials (magnet materials Nos. C to L) having the composition range of the embodiment in the present invention. It is found that the samples in Examples each had a small $\Delta H_{cJ}$ of 8 to 51 kA/m and thus had sufficiently excellent magnetic properties when being cooled even at a slow cooling rate (even at a slow cooling level) in the high-temperature heat treatment step. In contrast, some samples in Comparative Examples (specimens Nos. 36 to 47) were obtained by applying the high-temperature heat treatment step and the low-temperature heat treatment step embodiment according to the present invention, to the R-T-B based sintered magnet materials (magnet materials Nos. M to P) in each of which the Cu content was smaller than that in the composition range of the embodiment in the present invention. The samples in Comparative Examples (specimens Nos. 36 to 47) each had a large $\Delta H_{cJ}$ of 179 to 233 kA/m. That is, it is found that the samples in Comparative Examples did not exhibit excellent magnetic properties when the cooling rate in the high-temperature heat treatment step was slow (at a slow cooling level).

Note that when the cooling rate in the high-temperature heat treatment step deviated from the range of the embodiment in the present invention (less than 5° C./min), for example, as shown in the specimen No. 13, $H_{cJ}$ was drastically reduced, compared to the samples in Examples (specimens Nos. 9 to 12) of the same R-T-B based sintered magnet materials. Other samples in Comparative Examples (specimens Nos. 1 to 8) were obtained by applying the high-temperature heat treatment step and the low-temperature heat treatment step of the embodiment in the present invention, to the R-T-B based sintered magnet materials (magnet materials Nos. A and B) in which the Cu content was larger than that in the composition range of the embodiment in the present invention. Though these samples in Comparative Examples (specimens Nos. 1 to 8) had a small $\Delta H_{cJ}$, these samples could not exhibit $B_r$ and $H_{cJ}$ at the same level compared with the specimens in Examples having substantially the same composition except for the Cu content (The specimens Nos. 1 to 4 (magnet material No. A) were compared with the specimens Nos. 9 to 12 (magnet material No. C) in Examples, and the specimens Nos. 5 to 8 (magnet material No. B) were compared with Nos. 19 to 22 (magnet material No. F).

The specimens Nos. 48 and 49 that did not satisfy the inequality expression (1) or (2) and the specimen No. 50 that had the B content exceeded the range of the embodiment in the present invention could not exhibit the $H_{cJ}$ at the same level as that of the samples in Examples of the embodiments in the present invention. The specimens Nos. 51 and 52 that had the B content lower than the range of the embodiment in the present invention or that had the Ga content outside the range of the embodiment in the present invention could not exhibit $B_r$ at the same level as the specimens Nos. 19 to 22 (magnet material No. F), even though the specimens Nos. 51 and 52 had substantially the same composition as the specimens Nos. 19 to 22 except for B and Ga.

Example 2

The obtained R-T-B based sintered magnet materials made of the magnet material No. C shown in Table 1 and prepared in the same way as in Example 1 was subjected to the high-temperature heat treatment step on the conditions shown in Table 3. Regarding the specimen No. 60 shown in Table 3, the R-T-B based sintered magnet material was heated to 700° C., and then cooled from the heating temperature (700° C.) to 300° C. at an average cooling rate of 50° C./min, and further cooled from 300° C. to the room temperature at an average cooling rate of 3° C./min. Note that in the high-temperature heat treatment step, a heating holding time was 3 hours for all specimens. Thus, the specimen No. 60 was heated to 700° C. and held at this temperature for 3 hours. The specimens Nos. 61 and 62 were also subjected to the high-temperature heat treatment step in the same way on the conditions shown in Table 3. Note that in the high-temperature heat treatment step, an average cooling rate from 300° C. to the room temperature was set at 3° C./min for each of the specimens Nos. 61 and 62, like the specimen No. 60. Thereafter, the R-T-B based sintered magnet material obtained after the high-temperature heat treatment was subjected to the low-temperature heat treatment step at the temperature shown in Table 3. For each of the specimens, in the low-temperature heat treatment step, a heating holding time was set at 2 hours, and the cooling was performed at a cooling rate of 2° C./min from the holding temperature to the room temperature. Thus, for example, the specimen No. 60 was heated to 470° C. and held at this temperature for 2 hours, followed by cooling to the room temperature at a cooling rate of 2° C./min. The heating temperature and cooling rate in each of the high-temperature heat treatment step and the low-temperature heat treatment step were measured by installing a thermocouple on the R-T-B based sintered magnet material. The R-T-B based sintered magnet of each specimen obtained after the low-temperature heat treatment step was machined, followed by measurement of the $B_r$ and $H_{cJ}$ of each specimen in the same way as in Example 1. The measurement results are shown in Table 3.

TABLE 3

| Specimen No. | High-temperature heat treatment step: Temperature (° C.) | High-temperature heat treatment step: Cooling rate (° C./min) | Low-temperature heat treatment step: Temperature (° C.) | Magnetic properties: Br (T) | Magnetic properties: $H_{cJ}$ (kA/m) | Magnet material No. | Note |
|---|---|---|---|---|---|---|---|
| 60 | 700 | 50 | 470 | 1.367 | 1,079 | C | Comparative Example |
| 61 | 800 | 50 | 400 | 1.385 | 1,056 | | Comparative Example |
| 62 | 800 | 50 | 560 | 1.364 | 1,278 | | Comparative Example |

As shown in Table 3, the specimen No. 60 in which the temperature of the high-temperature heat treatment step was outside the range of the embodiment in the present invention and the specimens Nos. 61 and 62 in each of which the temperature of the low-temperature heat treatment step was outside the range of the embodiment in the present invention could not exhibit the $H_{cJ}$ at the same level as that in Examples of the embodiment in the present invention.

Example 3

As each of specimens Nos. 70 to 73, 1,500 pieces (approximately 90 kg) of R-T-B based sintered magnet materials (each piece having 20 mm in length, 20 mm in width, and 20 mm in thickness) made of the magnet material No. G shown in Table 1 were prepared in the same way as in Example 1. Likewise, as each of specimens Nos. 74 to 76, 1,500 pieces (approximately 90 kg) of R-T-B based sintered magnet materials (each piece having 20 mm in length, 20 mm in width, and 20 mm in thickness) made of the magnet material No. M shown in Table 1 were prepared in the same way as in Example 1. The prepared R-T-B based sintered magnet materials were subjected to the high-temperature heat treatment step and the low-temperature heat treatment step on the conditions shown in Table 4. In each of the high-temperature heat treatment step and the low-temperature heat treatment step, 1500 pieces were treated in a single process (one batch process). Regarding the specimen No. 70 shown in Table 4, the R-T-B based sintered magnet material made of the magnet material No. G shown in Table 1 was heated to 800° C., and then cooled from the heating temperature (800° C.) to 300° C. at an average cooling rate of 50° C./min, and further cooled from 300° C. to the room temperature at an average cooling rate of 3° C./min. Note that in the high-temperature heat treatment step, a heating holding time was 3 hours for all specimens. Thus, the specimen No. 70 was heated to 800° C. and held at this temperature for 3 hours. The specimens Nos. 71 to 76 of the magnet material Nos. shown in Table 1 were also subjected to the high-temperature heat treatment step in the same way on the conditions shown in Table 4. Note that in the high-temperature heat treatment step, an average cooling rate from 300° C. to the room temperature was set at 3° C./min for each of the specimens Nos. 71 to 76, like the specimen No. 70.

Thereafter, the R-T-B based sintered magnet material obtained after the high-temperature heat treatment was subjected to the low-temperature heat treatment step at the temperature shown in Table 4. For each of the specimens, in the low-temperature heat treatment step, a heating holding time was set at 2 hours, and the cooling was performed at a cooling rate of 2° C./min from the holding temperature to the room temperature. Thus, for example, the specimen No. 70 was heated to 470° C. and held at this temperature for 2 hours, followed by cooling to the room temperature at a cooling rate of 2° C./min. The heating temperature and cooling rate in each of the high-temperature heat treatment step and the low-temperature heat treatment step were measured by installing a thermocouple on the R-T-B based sintered magnet material. Three thermocouples were installed on the R-T-B based sintered magnet material positioned at each of the "end portion" and the "center portion" of a heat treating furnace to be mentioned later to conduct the measurement. The R-T-B based sintered magnet of each specimen obtained after the low-temperature heat treatment step was machined, followed by measurement of the $B_r$ and $H_{cJ}$ of each specimen in the same way as in Example 1. The measurement results are shown in Table 5. FIG. 1 is a schematic plan view showing the arrangement positions of specimens within the heat treating furnace in the high-temperature heat treatment step. More specifically, the R-T-B based sintered magnet materials (specimens) were introduced to fill a treating container 3. The treating container 3 was set in a heat treating furnace 1 to perform the high-temperature heat treatment step. The term "position in furnace" shown in Table 5 indicates the arrangement positions of the R-T-B based sintered magnet materials in the heat treating furnace 1. The term "end portion" as used herein indicates a specimen treated in the position designated by a mark "O" (end portion 10) shown in FIG. 1. The measured results of $B_r$ and $H_{cJ}$ of the R-T-B based sintered magnet finally obtained from this specimen (after the low-temperature heat treatment step) were shown below the item name "end portion" in Table 5. On the other hand, the term "center portion" shown in the table indicates a specimen treated in the position designated by a mark "□" (center portion 20) shown in FIG. 1. The measured results of $B_r$ and $H_{cJ}$ of the R-T-B based sintered magnet finally obtained from this specimen were shown below the item name "center portion" in Table 5.

TABLE 4

| Specimen No. | High-temperature heat treatment step: Temperature (° C.) | High-temperature heat treatment step: Cooling rate (° C./min) | Low-temperature heat treatment step: Temperature (° C.) | Magnet material No. | Note |
|---|---|---|---|---|---|
| 70 | 800 | 50 | 470 | G | Example |
| 71 | 800 | 25 | 470 | | Example |
| 72 | 800 | 10 | 470 | | Example |
| 73 | 800 | 5 | 470 | | Example |
| 74 | 800 | 50 | 470 | M | Comparative Example |
| 75 | 800 | 25 | 470 | | Comparative Example |
| 76 | 800 | 5 | 470 | | Comparative Example |

TABLE 5

| Specimen No. | Position in furnace: End portion: Br (T) | End portion: $H_{cJ}$ (kA/m) | Center portion: Br (T) | Center portion: $H_{cJ}$ (kA/m) | Note |
|---|---|---|---|---|---|
| 70 | 1.344 | 1,464 | 1.341 | 1,403 | Example |
| 71 | 1.341 | 1,445 | 1.339 | 1,398 | Example |
| 72 | 1.342 | 1,411 | 1.340 | 1,388 | Example |
| 73 | 1.341 | 1,406 | 1.338 | 1,360 | Example |
| 74 | 1.342 | 1,413 | 1.338 | 1,283 | Comparative Example |
| 75 | 1.341 | 1,408 | 1.339 | 1,224 | Comparative Example |
| 76 | 1.336 | 1,226 | 1.334 | 1,198 | Comparative Example |

As shown in Table 5, in each of the specimens Nos. 70 to 73 which are Examples of the embodiment in the present invention, a difference in $H_{cJ}$ between the end portion and center portion of the furnace was 61 kA/m or less. On the other hand, in each of the specimens Nos. 74 and 75 in which the Cu composition was outside of the range of the embodiment in the present invention, a difference in $H_{cJ}$ between the end portion and center portion of the furnace was large, namely, 130 kA/m or more. In the specimen No. 76, $B_r$ and $H_{cJ}$ were drastically reduced. As can be seen from the specimens Nos. 70 to 73, a difference in $H_{cJ}$ of the specimen between the end portion and the center portion of the furnace was 61 kA/m (for the specimen No. 70) at a cooling rate of 50° C./min, whereas a difference in $H_{cJ}$ was small, namely, 47 kA/m or less (for the specimens Nos. 71 to 73) at a cooling rate of 25° C./min to 5° C./min. Thus, the cooling rate of 25° C./min to 5° C./min can suppress variations in the $H_{cJ}$ depending on the mounting position in the furnace. Further, the cooling rate of preferably 25° C./min to 10° C./min can suppress variations in the $H_{cJ}$ depending on the mounting position in the furnace, while exhibiting the high $B_r$ and the high $H_{cJ}$.

Example 4

With regard to each of the specimens Nos. 9, 12, 40, and 43, the respective ratios of the configuration phases, including a main phase, an R-T-Ga phase, and an R—Ga—Cu phase, in the R-T-B based sintered magnet material after the high-temperature heat treatment step were determined. The ratios of the configuration phases were determined in the following way. The R-T-B based sintered magnet material after the high-temperature heat treatment step was polished using a cross section polisher (trade name "SM-09010") manufactured by JEOL Ltd., and then had its microstructure observed (in an observation area of approximately 50 m×50 μm) by a field emission scanning electron microscope (FE-SEM) (trade name "JSM-7001F") manufactured by JEOL Ltd., followed by conducting composition analysis using an electron probe x-ray microanalyzer "EPMA-160" manufactured by SHIMADZU Corporation. In this way, the main phase, the R-T-Ga phase, and the R—Ga—Cu phase were determined. Note that as mentioned above, in such sortation, the R-T-Ga phase is defined as a phase that included: 15% or more by mass and 65% or less by mass of R; 20% or more by mass and 80% or less by mass of T; and 2% or more by mass and 20% or less by mass of Ga. The R—Ga—Cu phase was one obtained by substituting Cu or a combination of Cu and Co for a part of the R—Ga phase and that included: 70% or more by mass and 95% or less by mass of R; and 5% or more by mass and 30% or less by mass of Ga. The ratios of the configuration phases composed of the main phase, the R-T-Ga phase, and the R—Ga—Cu phase in the field of view for the observation of the microstructure (within an observation area of 50 μm×50 μm) were determined by image analysis. The results are shown in Table 6. Furthermore, by using the same method, with regard to each of the specimens Nos. 9, 12, 40, and 43, the respective ratios of the configuration phases, including a main phase, an R-T-Ga phase, and an R—Ga—Cu phase, in the R-T-B based sintered magnet after the high-temperature heat treatment step and the low-temperature heat treatment step were determined. The results are shown in Table 7.

TABLE 6

| Specimen No. | Magnet material No. | High-temperature heat treatment step: Temperature (° C.) | High-temperature heat treatment step: Cooling rate (° C./min) | Ratios of configuration phases: Main phase vol % | Ratios of configuration phases: R—T—Ga phase vol % | Ratios of configuration phases: R—Ga—Cu phase vol % | Ratios of configuration phases: Others vol % | Note |
|---|---|---|---|---|---|---|---|---|
| 9 | C | 800 | 50 | 92.55 | 0.26 | 4.80 | 2.39 | Example |
| 12 | | 800 | 5 | 89.12 | 2.00 | 3.97 | 4.91 | Example |
| 40 | O | 800 | 50 | 92.92 | 0.24 | 4.18 | 2.68 | Comparative Example |
| 43 | | 800 | 5 | 89.97 | 2.55 | 1.39 | 6.09 | Comparative Example |

TABLE 7

| Specimen No | Magnet material No. | High-temperature heat treatment step: Temperature (° C.) | High-temperature heat treatment step: Cooling rate (° C./min) | Low-temperature heat treatment step: Temperature (° C.) | Ratios of configuration phases: Main phase vol % | Ratios of configuration phases: R—T—Ga phase vol % | Ratios of configuration phases: R—Ga—Cu phase vol % | Ratios of configuration phases: Others vol % | Note |
|---|---|---|---|---|---|---|---|---|---|
| 9 | C | 800 | 50 | 470 | 89.21 | 3.01 | 1.78 | 6.00 | Example |
| 12 | | 800 | 5 | 470 | 89.34 | 3.78 | 1.86 | 5.02 | Example |
| 40 | O | 800 | 50 | 470 | 90.28 | 4.34 | 1.72 | 3.69 | Comparative Example |
| 43 | | 800 | 5 | 470 | 90.74 | 3.77 | 1.17 | 4.32 | Comparative. Example |

As can be seen from the results of the specimens Nos. 9 and 12 shown in Table 6 as Examples of the embodiment in the present invention, the substantially same amount of the R—Ga—Cu phase was generated even at the slow cooling rate in the high-temperature heat treatment step (for the specimen No. 12), compared with at the high cooling rate or the rapid cooling in the high-temperature heat treatment step (for the specimen No. 9). In contrast, as can be seen from the results of the specimens Nos. 40 and 43 shown in Table 6 as Comparative Example in which the Cu content deviated from the range of the embodiment in the present invention, the amount of generated R—Ga—Cu phase was drastically decreased at the slow cooling rate in the high-temperature heat treatment step (for the specimen No. 43), compared with at the high cooling rate or the rapid cooling in the high-temperature heat treatment step (for the specimen No. 40).

Also, in the R-T-B based sintered magnet after the high-temperature heat treatment step and low-temperature heat treatment step, as can be seen from the results of the specimens Nos. 9 and 12 shown in Table 7 as Examples of the embodiment in the present invention, the substantially same amount of the R—Ga—Cu phase was generated even at the slow cooling rate in the high-temperature heat treatment step (for the specimen No. 12), compared with at the high cooling rate or the rapid cooling in the high-temperature heat treatment step (for the specimen No. 9). In contrast, as can be seen from the results of the specimens Nos. 40 and 43 shown in Table 7 as Comparative Example in which the Cu content deviated from the range of the embodiment in the present invention, the amount of generated R—Ga—Cu phase was drastically decreased at the slow cooling rate in the high-temperature heat treatment step (for the specimen No. 43), compared with at the high cooling rate or the rapid cooling in the high-temperature heat treatment step (for the specimen No. 40).

The present application claims priority to Japanese Patent Application No. 2014-188836 filed on Sep. 17, 2014, the disclosure of which is incorporated herein by reference in its entirety.

DESCRIPTION OF REFERENCE NUMERALS

1: Heat treating furnace
2: Treating container
10: End portion
20: Center portion

The invention claimed is:

1. A method for manufacturing an R-T-B based sintered magnet, which comprises:

1) a step of preparing an R-T-B based sintered magnet material by sintering a molded body, the R-T-B based sintered magnet material comprising:

30.11% or more by mass and 33.11% or less by mass of R (R being at least one element of rare earth elements and indispensably containing Nd);

0.88% or more by mass and 0.90% or less by mass of B;

0.38% or more by mass and 0.63% or less by mass of Ga;

more than 0.21% by mass and 0.50% or less by mass of Cu;

0.11% or more by mass and 0.23% or less by mass of Al; and

0% or more by mass and 0.1% or less by mass of M (M being one or both of Nb and Zr), with the balance being T (T being Fe and Co, and 90% or more of T in terms of mass ratio being Fe) and inevitable impurities, the R-T-B based sintered magnet material satisfying inequality expressions (1) and (2) below:

$$[T]-72.3[B]>0 \quad (1)$$

$$([T]-72.3[B])/55.85<13[Ga]/69.72 \quad (2)$$

where [T] is a T content in percent by mass, [B] is a B content in percent by mass, and [Ga] is a Ga content in percent by mass;

2) a high-temperature heat treatment step of heating the R-T-B based sintered magnet material to a heating temperature of 730° C. or higher and 1,020° C. or lower and then cooling the R-T-B based sintered magnet material to 300° C. at a cooling rate of 10° C./min or more and 25° C./min or less; and 3) a low-temperature heat treatment step of heating the R-T-B based sintered magnet material after the high-temperature heat treatment step to 450° C. or higher and 490° C. or lower.

2. The method for manufacturing an R-T-B based sintered magnet according to claim 1, wherein the R-T-B based sintered magnet material includes 30.11% or more by mass and 31.0% or less by mass of R.

* * * * *